US007681783B2

(12) United States Patent
Stephenson

(10) Patent No.: US 7,681,783 B2
(45) Date of Patent: Mar. 23, 2010

(54) BAG IN BOX (BIB)

(76) Inventor: John Stephenson, 25 Campriano Drive, Warwick (GB) CV34 4NQ ( * ) Notice: Subject to any disclaimer, the term of this patent is extended or adjusted under 35 U.S.C. 154(b) by 650 days.

(21) Appl. No.: 10/561,676

(22) PCT Filed: Jun. 17, 2004

(86) PCT No.: PCT/GB2004/002609

§ 371 (c)(1),
(2), (4) Date: Dec. 20, 2005

(87) PCT Pub. No.: WO2005/000705

PCT Pub. Date: Jan. 6, 2005

(65) Prior Publication Data

US 2006/0180643 A1 Aug. 17, 2006

(30) Foreign Application Priority Data

Jun. 25, 2003 (GB) ..... 0314815.2

(51) Int. Cl.
*B65D 5/56* (2006.01)

(52) U.S. Cl. ..... 229/117.3; 229/117.35; 220/495.01

(58) Field of Classification Search ..... 229/117.3, 229/117.35; 220/495.05, 495.01
See application file for complete search history.

(56) References Cited

U.S. PATENT DOCUMENTS 1,207,421 A 12/1916 Lord
2,412,544 A 12/1946 Waters
2,721,674 A 10/1955 Lazard
2,946,494 A 7/1960 Kuss
2,954,901 A 10/1960 Winstead
2,973,119 A 2/1961 Parker
3,042,271 A 7/1962 Winstead
3,087,655 A 4/1963 Scholle
3,090,526 A 5/1963 Hamilton et al.
3,100,587 A 8/1963 Cox, Jr.
3,171,571 A 3/1965 Daniels
3,184,117 A 5/1965 Sanderson
3,233,817 A 2/1966 Casady
3,349,960 A 10/1967 Ketler
3,363,807 A 1/1968 Powell
3,448,889 A 6/1969 Malpas
3,458,084 A 7/1969 Laurizio
3,599,840 A * 8/1971 Speas ..... 222/183
4,165,023 A 8/1979 Schmit
4,174,051 A 11/1979 Edwards et al.
4,176,748 A 12/1979 Beane
4,209,092 A * 6/1980 Jones ..... 206/423

(Continued)

FOREIGN PATENT DOCUMENTS

DE 89082702 7/1989

(Continued)

*Primary Examiner*—Nathan J Newhouse
*Assistant Examiner*—Christopher Demeree
(74) *Attorney, Agent, or Firm*—Jovan N. Jovanovic; Vladan M. Vasiljevic; The Watson I.P. Group, PLC

(57) ABSTRACT

A bag in box container package (10) has a recessed neck piece (14)—such as a discrete insert or part-integrated with box or bag—between inner bag liner (12) and outer box carton (11), to emulate a (rigid neck) jerrycan; with optional collapse fold, pull-out spout (33) and handle (34).

14 Claims, 15 Drawing Sheets

U.S. PATENT DOCUMENTS

| | | | | | |
|---|---|---|---|---|---|
| 4,280,634 | A | | 7/1981 | Wiesenberger et al. | |
| 4,322,018 | A | | 3/1982 | Rutter | |
| 4,379,455 | A | | 4/1983 | Deaton | |
| 4,445,550 | A | | 5/1984 | Davis et al. | |
| 4,524,883 | A | | 6/1985 | Herring | |
| 4,560,090 | A | | 12/1985 | Okushita | |
| 4,696,840 | A | | 9/1987 | McCullough et al. | |
| 4,781,314 | A | | 11/1988 | Schoonover et al. | |
| 4,815,631 | A | | 3/1989 | Eeg et al. | |
| 4,834,255 | A | | 5/1989 | Boots | |
| 5,156,295 | A | * | 10/1992 | Gordon et al. | 229/117.35 |
| 5,265,753 | A | * | 11/1993 | Moorman | 229/117.3 |
| 5,474,203 | A | | 12/1995 | Baker | |
| 5,715,992 | A | | 2/1998 | Andrews, Sr. et al. | |
| 5,803,346 | A | | 9/1998 | Baker et al. | |
| 5,826,752 | A | | 10/1998 | Latimer | |
| 5,909,841 | A | | 6/1999 | Andrews, Sr. et al. | |
| 6,053,401 | A | | 4/2000 | Andrews, Sr. | |
| 6,059,182 | A | * | 5/2000 | Wein | 229/219 |
| 6,062,431 | A | | 5/2000 | Geshay | |
| 6,196,452 | B1 | | 3/2001 | Andrews, Sr. et al. | |
| 6,209,781 | B1 | | 4/2001 | Sylvester et al. | |
| 6,290,124 | B2 | | 9/2001 | Andrews, Sr. et al. | |
| 6,375,040 | B1 | | 4/2002 | Allanson et al. | |
| 6,378,733 | B1 | | 4/2002 | Boonzaier | |
| 6,446,859 | B1 | | 9/2002 | Holladay | |
| 6,637,623 | B2 | | 10/2003 | Muise et al. | |
| 6,651,845 | B1 | | 11/2003 | Schroeder | |
| 6,736,289 | B2 | | 5/2004 | Cook et al. | |
| 6,877,654 | B2 | | 4/2005 | Bartlett et al. | |
| 2001/0030228 | A1 | * | 10/2001 | Todjar-Hengami | 229/120.03 |
| 2002/0047040 | A1 | | 4/2002 | Andrews, Sr. et al. | |
| 2003/0160092 | A1 | | 8/2003 | Philips et al. | |

FOREIGN PATENT DOCUMENTS

| | | | |
|---|---|---|---|
| DE | 3802793 | A1 | 8/1989 |
| EP | 0053310 | A1 | 11/1981 |
| EP | 0225677 | | 6/1987 |
| EP | 1 129 961 | A2 | 5/2001 |
| FR | 2 112 854 | | 11/1970 |
| FR | 2 371 355 | | 6/1978 |
| FR | 2 436 082 | | 9/1978 |
| FR | 2 446 233 | | 12/1978 |
| FR | 2 483 893 | | 6/1980 |
| FR | 2 624 107 | | 11/1988 |
| GB | 927866 | | 10/1959 |
| GB | 959306 | | 5/1964 |
| GB | 1207421 | | 9/1970 |
| GB | 2403467 | | 5/2005 |
| JP | 8048376 | | 2/1996 |
| JP | 10147369 | | 6/1998 |
| JP | 10251417 | | 9/1998 |
| JP | 2000 185743 | | 7/2000 |
| JP | 2002012265 | | 1/2002 |
| WO | WO- 88/08401 | | 11/1988 |
| WO | WO- 91/19651 | | 12/1991 |
| WO | WO 93/14984 | | 8/1993 |
| WO | WO 94/19255 | | 9/1994 |
| WO | WO 96/01766 | | 1/1996 |
| WO | WO 01/21496 | A1 | 3/2001 |
| WO | WO 2005/080219 | A2 | 9/2005 |
| WO | WO 2005/080219 | A3 | 9/2005 |

* cited by examiner

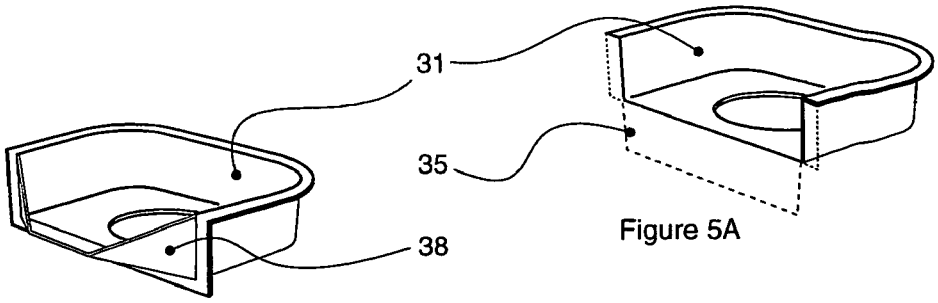
Figure 5A
Figure 5B
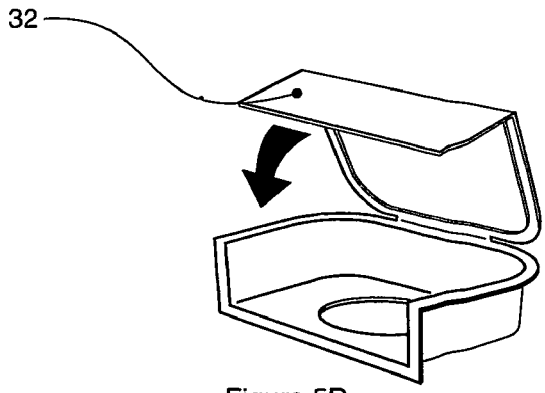
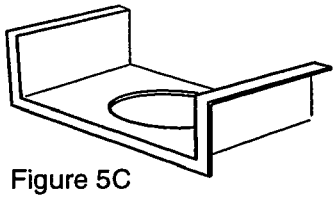
Figure 5D
Figure 5C
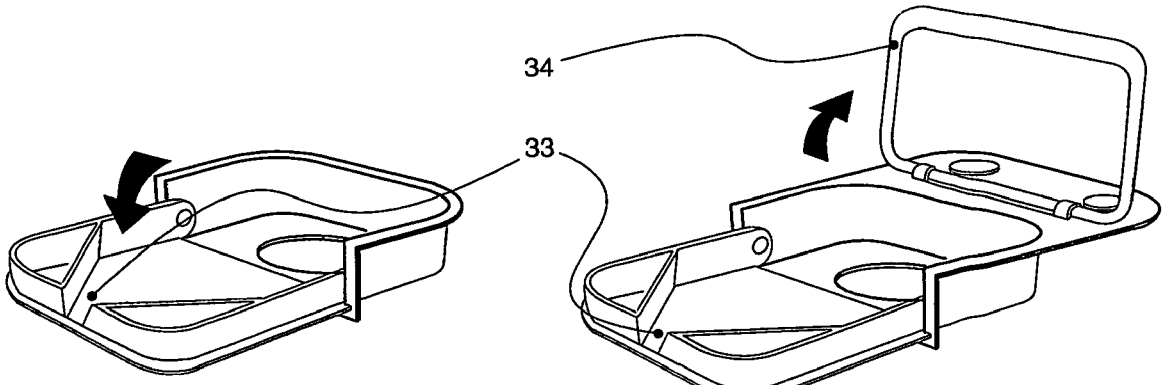
Figure 5E
Figure 5F
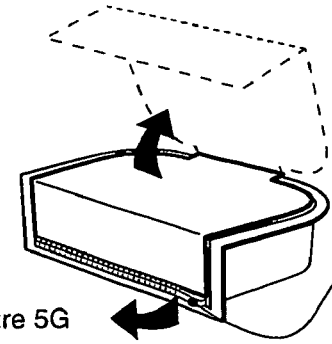
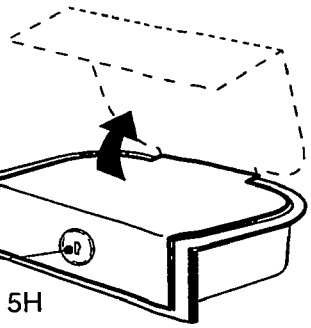
Figure 5G
Figure 5H

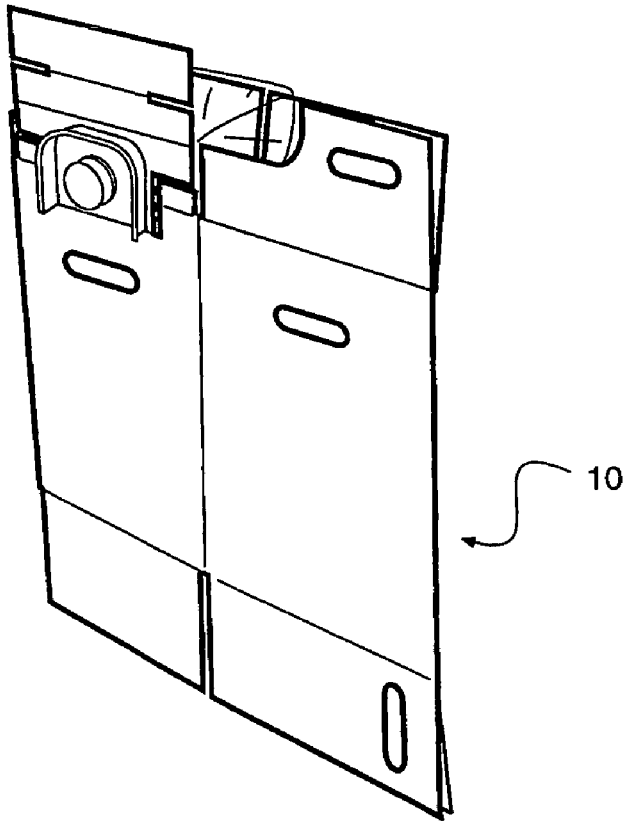
Figure 10B
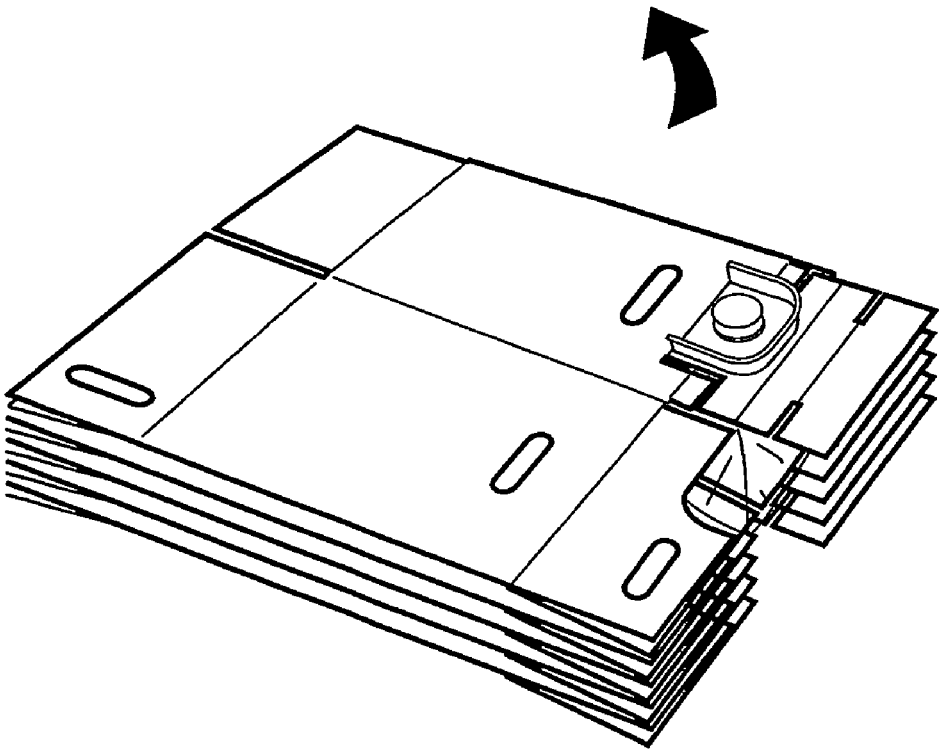

BAG IN BOX (BIB)

This invention relates to packaging and is particularly, but not exclusively, concerned with packaging liquids—or other flowable materials, such as powders or granules—in so called bag-in-box (BIB) containers.

In the BIB approach, a flexible-walled bag is used as an (internal) liner—and housed within a protective outer box carton, typically of semi-rigid cardboard.

The term 'carton' is used herein for convenience to embrace, not merely traditional cardboard—but, as regards the scope of the present invention, other materials, such as corrugated, solid or laminated plastics or composites.

For esoteric applications, stranded or fibre-reinforcement could also be contemplated.

BIB Alternatives—Jerrycans

A prime BIB target for substitution is a so-called jerrycan (or jerrican), being a (blow) moulded semi-rigid walled container, with an integrated neck spout (typically threaded) and complementary closure cap.

Mould tool set up costs are prohibitive for implementing low volume changes—precluding bespoke customer configurations or formats.

Some aspects of the present invention seek to contrive a direct competitive substitute for jerrycans, with further advantages.

BIB—Box Carton

A box carton is fabricated—typically die cut—from a flat carton blank sheet {—and is collapse foldable}.

Carton erection from a flat sheet 2-D form to an erect 3-D form creates a hollow shell for bag liner housing.

Generally, the shell housing completely envelopes shrouds or wraps the vulnerable bag liner and its flowable contents—so protecting it from casual impact, puncture and contents spillage.

Thus a bag liner is commonly wrapped up and sealed in a box carton.

However, issues of access to the bag and contents arise post box carton enclosure.

BIB—Bag

A bag liner is typically of plastics thin film—extruded as tubing, collapsed into a flat web.

This web can be rolled up, as a continuous length—or segmented into individual flat bags, which can be stacked.

Film thickness and material reflects a balance between robustness and cost.

Single or multiple layer or ply bag constructions may be employed.

Localised (corner edge) seam welds can help brace or define a (regular) erect form.

Having the bag fill to a predetermined (outer) contour or form, consistent with that of the intended outer carton shroud, makes for easier installation of the bag within the carton—such as by insertion from one end of a partially erected carton configuration.

Alternatively, a generic (free-form) so-called 'pillow bag' may be used to minimise overall manufacturing costs.

Bag Port

Basic bag liners commonly feature a reinforced fill and discharge port, forming or configured for location of, a contents access neck or spout.

Such bag liners may be sealed upon fill—and so require seal puncture, by say local discharge spout penetration, to allow controlled contents discharge.

Some bag variants integrate the bag wall with a semi-rigid neck upstand—for removable closure fitment.

This allows a pre-formed neck thread, with a complementary threaded screw closure cap.

Bag Format

Filled bag profiles may leave wasteful voids between (curvilinear)bag and (rectilinear)container.

Certain bag constructions have been contrived to adopt a more rectangular filled form, complementary to that of the carton outer, through judicious disposition of joining, stiffening or profiling seams.

An example is the proprietary CPAC QUAD™ bag of single skin, with four upright side corner edges and an 'H' pattern base weld to achieve a cuboid form upon contents fill.

A particular QUAD CLASSIC™ bag variant adopts a double-walled construction, in which a cylindrical inner bag is secured locally to an outer bag intermediate its corners.

The outer bag is a 'standard' balloon or pillow bag made from a single sheet—folded and edge seam welded to form a 'cuboid' bag form upon contents fill.

Internally, a cylinder of sheet material is attached in 'upright' strips along inner side walls of the outer bag.

As the internal cylinder is not secured at the corners of the external bag—upon fill, (liquid) contents flows into voids between internal and external walls.

These in turn form corner 'posts' or pillars—bringing the overall bag into a more defined 'cube' form, and contributing structural strength, stiffness and rigidity.

Bag Access

With a basic BIB format, bag fill is generally undertaken on dedicated fill line—remotely of, or at least as a discrete step from, cartoning.

Bags can be grasped at a fill neck or collar upstand, by a location flange or rim—and supported, or rather suspended therefrom, for contents fill.

Bag construction can be stressed to allow this—a factor used to advantage in the present invention for bag support within a box carton.

A closure/seal is fitted upon fill— and the filled bag dropped, as a free-form bulging sack, upon a feed conveyor—and thence to a cartoning station.

Filled bags are introduced into a part pre-assembled carton (in tubular form)—typically through open flaps at one (upper) end.

Once a bag is inserted into an outer box carton—the carton (opposite end flaps) is closed around.

Thus bag (port) contents access requires opening (one end of) the carton.

In a BIB refinement, a bag neck stem is fed through—and so located by—a complementary aperture cut-out in one end flap.

This preserves exposure of a protruding neck upstand and attendant closure beyond the box carton, for ease of contents access.

However, this arrangement is unsuitable for post-assembly fill, as with, say, a jerrycan—in what is commonly an environment wet with contents spillage.

Thus a box carton is not usually moisture-proof, but can absorb and be degraded by wetting.

Nor is a coupled bag sufficiently braced to take engagement and trigger loads from a downward fill dispenser head.

A protruding bag neck is vulnerable in handling and dropping.

The neck also interrupts the otherwise rectangular box carton outer form, so impeding compact packing and stacking.

Bag Contents Fill

Bag contents fill is a prime consideration for a contents manufacturer.

Generally, dedicated automated filling lines are employed for a bespoke BIB configuration.

Traditional bag fill typically prefaces insertion of a filled bag into a pre-formed carton assembly.

Insertion and cartoning themselves can be a mix of manual and mechanised steps.

Fill Machinery

Resources commitment inhibits a packaging change, if incompatible with established filling machinery.

Hitherto, fill machinery for moulded jerrycans has often been incompatible with that for BIB containers.

Again, a wet fill environment is a factor.

Thus substitution of BIB alternatives to jerrycans has been impeded, not only by the need to replicate jerrycan features (discussed later), but by the need for new fill machinery—a prohibitive investment.

Collapse Fold

A collapse-folded, pre-filled condition is advantageous for compact storage and transport.

In particular, voids between containers are minimised, if not eliminated, as compared with, say, semi-rigid hollow containers (jerrycans).

On the other hand, bag filling, carton erection and bag-into-carton insertion machinery is required.

Post Fill—Collapse Upon Empty Mode

For certain applications, a facility to collapse-fold, say into a compact flat-pack, after use—that is fill and contents discharge—would be advantageous.

Thus, say, a collapsible, refillable water carrier—which would flat collapse fold for transport and storage between contents fill would be very convenient.

Such a collapsible carrier would find a use in camping, military and charitable aid contexts.

Moreover, collapse for waste disposal or recycling and bag from carton separation, would be useful—not least to meet legislative requirements.

This is a facility which largely escapes jerrycans—albeit certain (wall) materials allow (empty mode) resilient can deformation and even crushing.

Rather, in large-scale industrial applications, jerrycans are commonly shipped back empty after use to a supplier or waste disposal station.

STATEMENT(S) OF INVENTION

According to one aspect of the invention, a Bag In Box (BIB) container [package] (10)—for flowable materials, including liquid, solid powders or particles—with an inner (contents) bag liner (12) locatable within an outer box carton (11), has a neck piece (14), between a bag neck (13) and carton aperture (24).

According to another aspect of the invention, a BIB container package, —for liquid or flowable material—comprises a bag inner liner and a box carton outer (shell); with a bag (neck) location and support element, (such as a neck piece), configured as any one, or a combination of:

discrete insert, element integral (or connected) with the bag, or some part of the bag, such as the bag neck or neck rim, element integral (or connected) with the carton, or some part of the carton, such as an end flap;

to create a (shallow) recess for a protruding bag neck.

This element partially enshrouds and protects the bag neck and an attendant closure (cap).

Free access to the neck and its removable closure is preserved, for contents fill and discharge.

Box structural performance (stiffness and rigidity) is unimpeded—and can even be enhanced by judicious top ledge and neck piece configuration.

The recess preserves a 'uniform'—say rectangular—box carton outer form or profile, in turn allowing compact packing and stacking.

The recess is conveniently at an upper side edge of the carton, to facilitate contents access—in particular contents discharge, by pouring from a tilted or upturned container.

An optional supporting spill ledge or splash back guard can be integrated with the neck piece to protect the box carton locally.

Handles, such as handle cut-outs or apertures, say with pre-formed handle inserts, can be incorporated in the box carton panels, to facilitate container lift and handling—such as to preserve control when pouring.

Push in handle flaps or tabs are desirably profiled or omitted altogether to avoid abrasion interference with bag liners upon relative movement in transit.

In some constructions, a discrete insert, such as a vacuum form, thin plastics sheet, shelf, ledge or tray, is fitted between a carton top (lid closure) flap and a bag neck location or retention rim.

In other variants, a stiffener, reinforcement or bracing plate—which can also serve as a spillage or splash guard—is integrated with a carton panel, such as a folding top or lid flap.

In yet other variants, a stiffener profile is mounted upon, or integrated with, a bag neck rim, or an existing location flange for a fill station support.

Hexagonal flanges or flanges with opposed flats are known for this purpose.

A judicious combination of such variants may also be adopted—where stiffening and location is shared between a supplementary insert, bag and carton.

These features allow use of a BIB configuration upon a jerrycan fill line—with minimal or no adaptation.

This makes it easier for an existing jerrycan user to switch to a BIB container package according to the invention—for the various packaging and disposal advantages outlined herein.

According to another aspect of the invention a container comprises an outer (box) carton with a recessed edge panel and an internal bag liner located and retained within the carton by a neck support collar such that a protruding bag neck is inset within the recess.

In a particular construction, a (collapse) fold box carton, of semi-rigid sheet material, [configured for a flexible walled inner liner] has a [location] aperture to receive a bag liner fill/discharge neck; and a preformed neck piece, configured to interfit between carton and bag neck.

Cartons are conveniently corrugated cardboard—for stiffness without undue weight—and faced with a smooth outer layer for printing.

That said, solid board and board with a variety of surface treatment(s)—such as for moisture resistance—may be employed.

The cardboard is desirably moisture resistant to survive a wet fill environment without material degradation.

Liners are thin walled synthetic plastics sheet—single or multiple ply, with edge jointing seams configured to afford a desired filled profile.

In a particular construction, a neck mounting or location aperture may be located in a tuck-in top flap of a folding carton blank.

A preformed insert of semi-rigid synthetic plastics material is configured as a neck collar, or yoke, for installation between carton and liner at juxtaposed liner neck and carton neck aperture regions.

Operationally, carton (pre-)assembly and erection into a 3-D form could be undertaken separately from and preparatory to, bag liner insertion.

In turn, bag liner insertion could be undertaken either before or after contents fill.

In that regard, a consideration is neck piece fitment in relation to closure cap disturbance.

Thus, if neck piece fitment requires closure cap removal, and bag neck pre-insertion through a carton aperture, bag fill post carton insertion is appropriate.

For (hygiene or sterile) sensitive contents, such as foodstuffs or pharmaceuticals, contents seal attends closure cap fitment.

This precludes cap closure removal after bag fill and thus dictates neck piece fitment sequence.

For example, a carton could be part erected from a collapsed flat folded form to an erect upstand with open base flaps and pre-folded top closure flaps.

Top flaps include a tuck-in deck flap, an inboard edge of which is folded into a transverse stiffener ridge.

This ridge upstand bounds a ledge for a discrete preformed stiffener element.

The stiffener is in turn part overlaid upon installation by remaining top lid flaps.

The neck insert could have a peripheral rim upstand, with an edge flange to overlie—or be sandwiched between—in-turned top flaps.

The neck insert—with features of the present invention (ie not merely a retention clip)—may be an interference, slot or snap-action fit upon a liner bag neck.

EMBODIMENTS

There now follows a description of some particular embodiments of the invention, by way of example only, with reference to the accompanying diagrammatic and schematic drawings, in which:

FIGS. 1A and 1B show initial stages of 3-D carton erection from a 2-D carton blank;

More specifically:

Figure 1A:
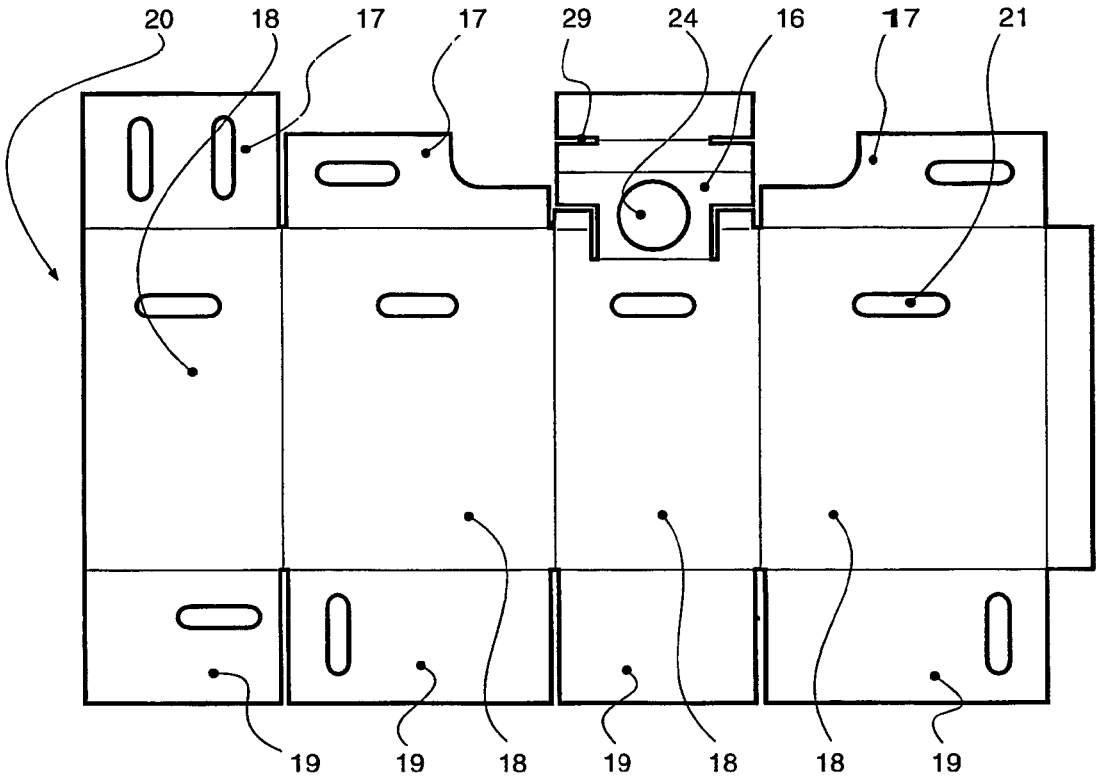
FIG. 1A shows a 2-D flat sheet carton blank, with a die cut periphery and localised handle apertures.
Figure 1B:
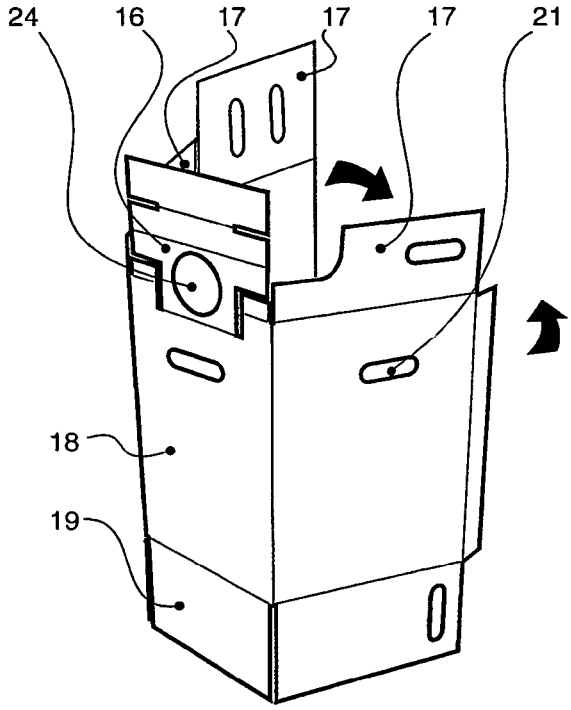
FIG. 1B shows folding of the carton blank of FIG. 1A into a tubular 3-D wrap enclosure.
Figure 2A:
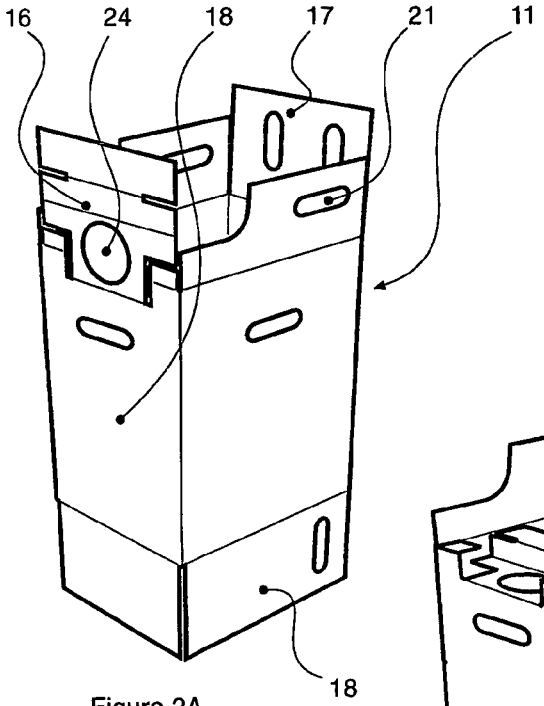
FIGS. 2A through 2E show progressive stages of box carton assembly from FIGS. 1A and 1B.
Figure 2B:
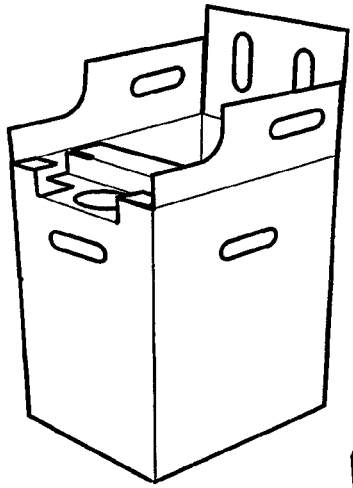
Figure 2C:
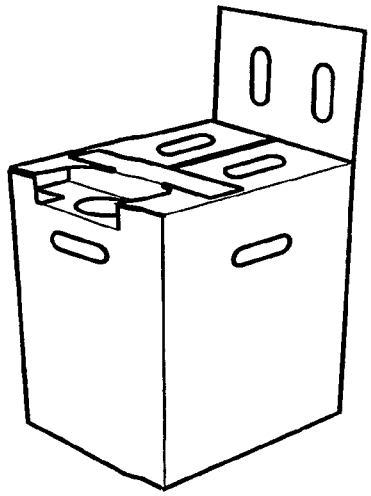
Figure 2D:
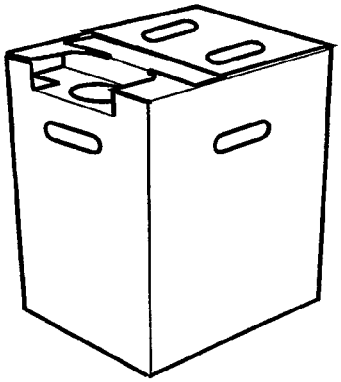
Figure 2E:
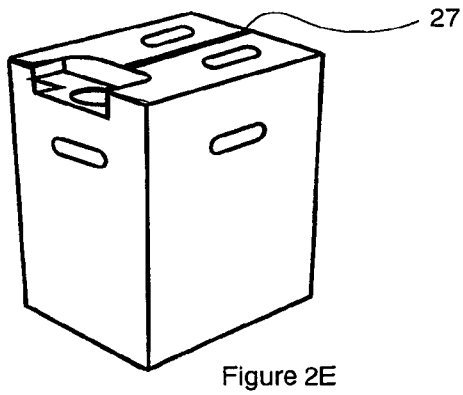
Figure 3A:
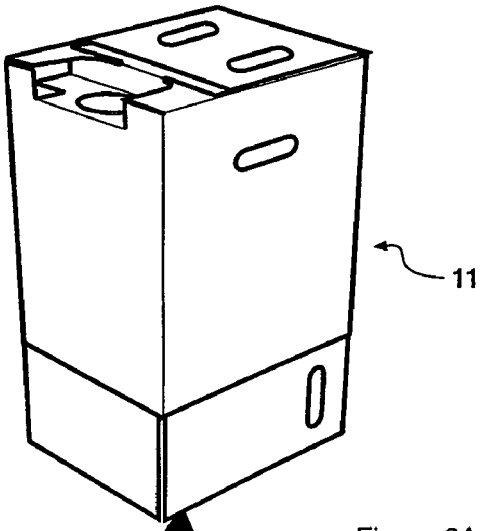
Figure 3B:
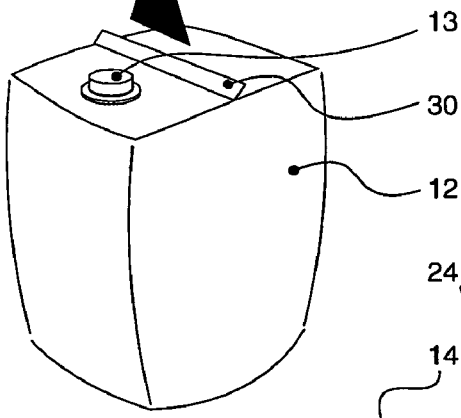
Figure 3B:
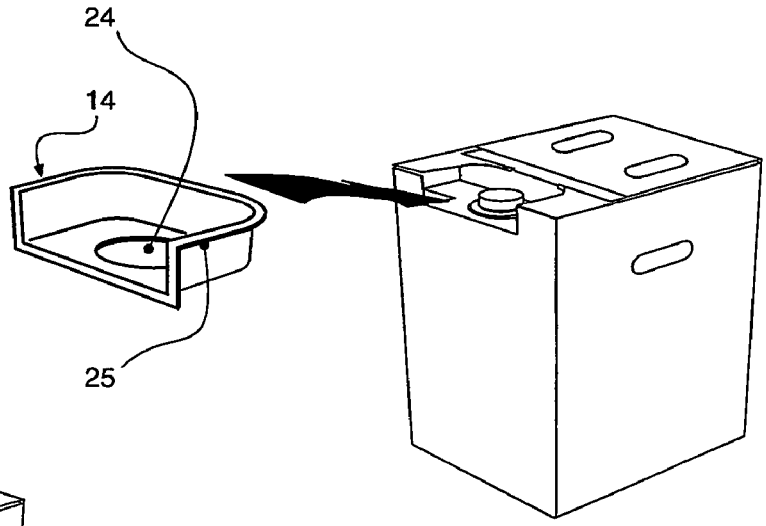
Figure 3C:
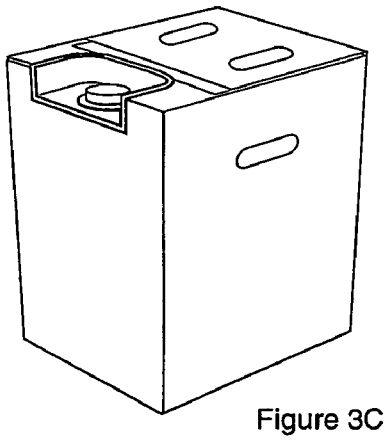
Figure 4A:
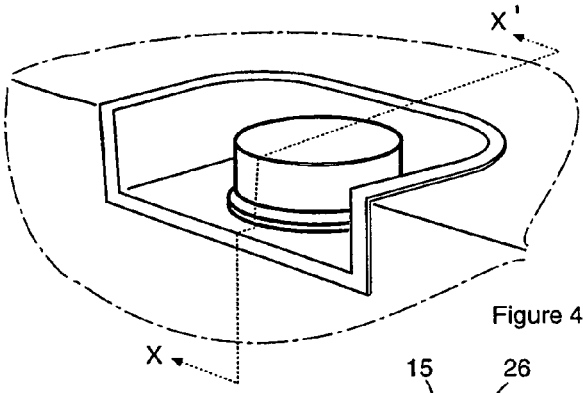
Figure 4B:
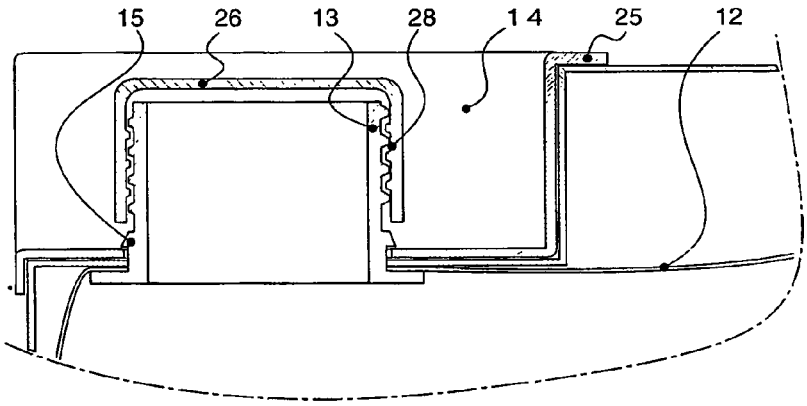
Figure 4C:
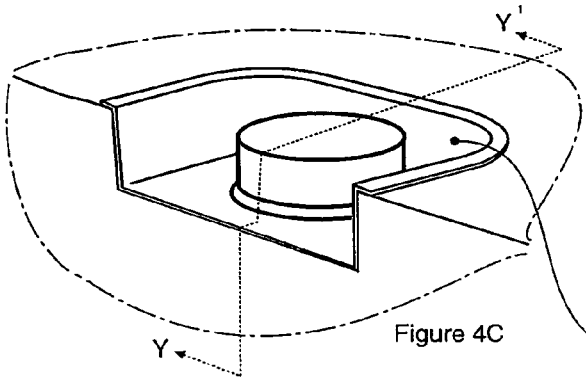
Figure 4E:
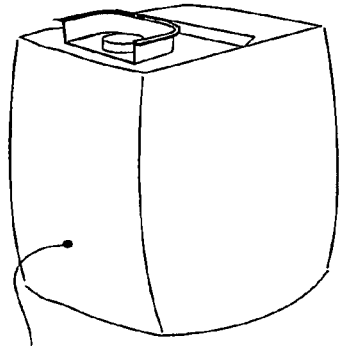
Figure 4D:
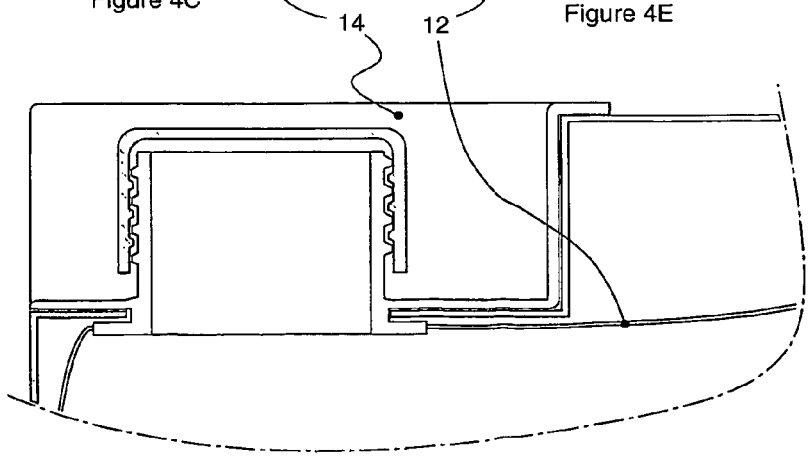
Figure 6A:
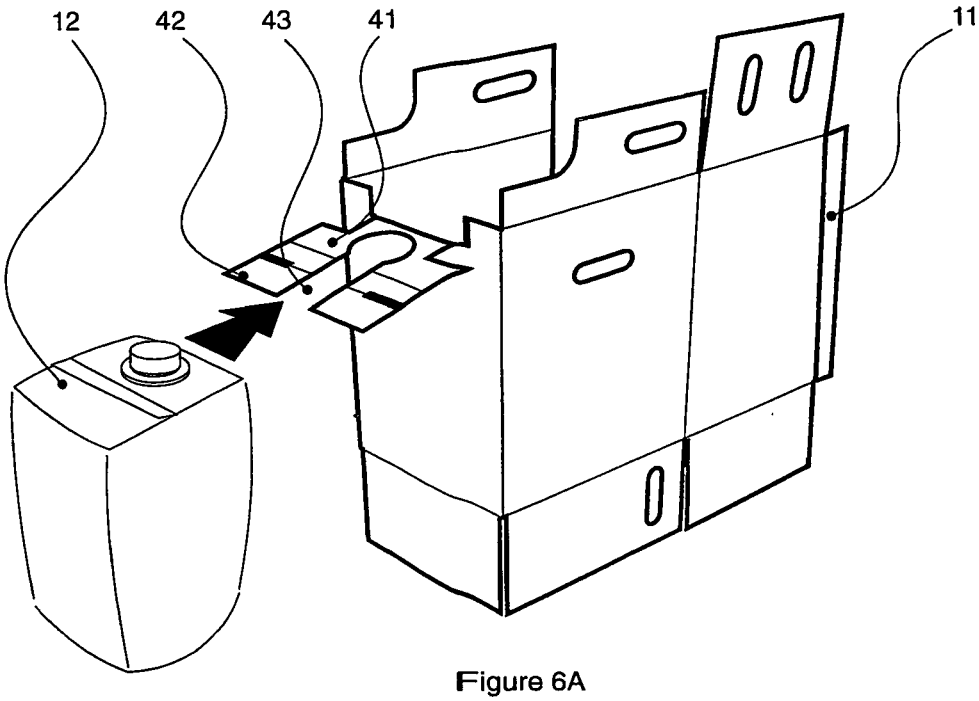
Figure 6B:
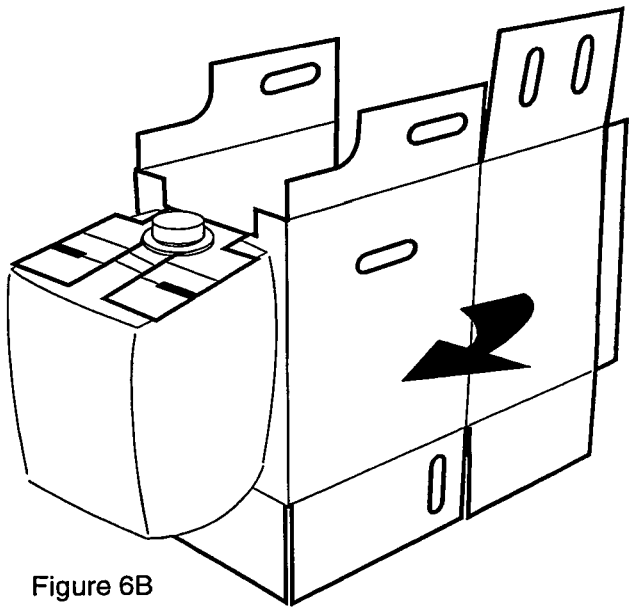
Figure 7A:
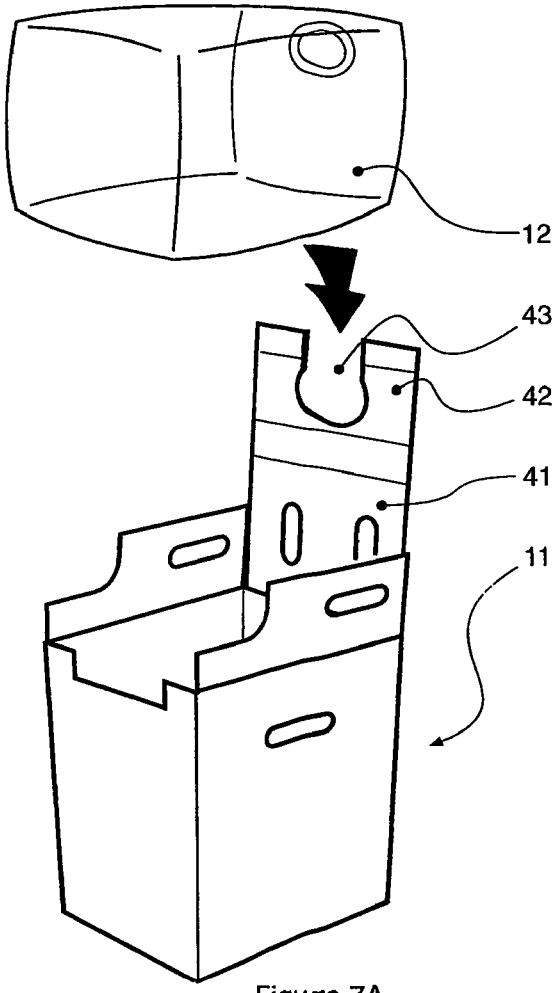
Figure 7B:
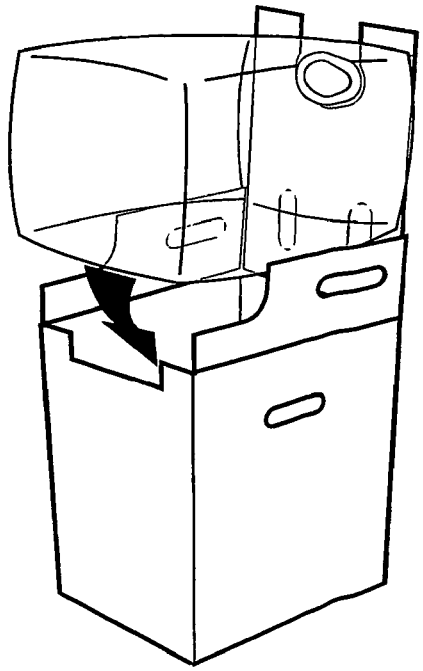

More specifically:

FIG. 2A shows, as an initial fold stage, a tubular sleeve carton form, with side walls wrapped around and (re-) united into an enclosure, but opposite end flaps left open;

FIG. 2B shows a successive fold stage to FIG. 1A, with base flaps closed (leaving aside contents insertion considerations for the present) and initial top flap in fold to create an inset step or ledge with an aperture to receive the neck of a bag liner (not shown);

FIG. 2C shows a following stage to FIG. 2B, with opposed top flaps now closed;

FIG. 2D shows a final carton closure stage to FIG. 2C, with top flaps fully closed— and optionally sealing tape across joins;

FIG. 2E shows an alternative carton end flap closure arrangement;

FIGS. 3A through 3C show an insertion sequence for a (generic) inner bag liner, into a part pre-erected outer box carton, of FIGS. 1A-B and 2A-E;

More specifically:

FIG. 3A shows an empty or pre-filled bag liner juxtaposed with an open bottom box carton;

FIG. 3B shows fitment of a neck piece insert or surmounting plate, to retain a protruding bag liner neck in a box carton top lid closure flap;

FIG. 3C shows closure of box carton bottom flaps to entrap and fully enshroud the bag liner within—apart from the protruding neck;

FIGS. 4A through 4D show variant detail of a neck piece insert location between box carton outer (lid flap) and inner bag liner;

More specifically:

FIG. 4A shows a detail perspective view of a neck piece insert fitted as in FIG. 3C;

FIG. 4B shows a section along X-X' in FIG. 4A, revealing bag liner neck rim, neck piece locator and box carton top flap interfit;

FIG. 4C shows a variant neck piece interfit profile to that of FIG. 4A;

FIG. 4D shows a section along the line Y-Y' in FIG. 4C;

FIG. 4E shows the variant neck piece of FIG. 4C fitted upon an inner bag liner without an outer box carton;

FIGS. 5A through 5H show variant neck piece or collar insert configurations for fitment between box carton outer and bag liner inner of FIGS. 1-4;

More specifically:

FIG. 5A shows a shallow open-sided tray profile, suitable for box carton flat pack stacking—but with an optional depending spill lip and front flange depicted in broken line;

FIG. 5B shows an integral pourer funnel;

FIG. 5C shows a minimal U-section yoke profile;

FIG. 5D shows a more fully developed C-section form with integral pop-up lid flap;

FIG. 5E shows a lid with integral pourer or funnel spout;

FIG. 5F shows an integrated pop-up/retractable folding handle;

FIG. 5G shows a variant of FIG. 5D with frangible peripheral tamper evident edge seal—which must be visibly removed or broken for lid opening; and FIG. 5H shows a lockable lid closure flap;

FIGS. 6A and 6B show alternative box carton outer and attendant erection and bag liner assembly sequences to that of FIGS. 1 through 3;

More specifically:

FIG. 6A shows a part-erected carton with out-turned ledge flat with split or bifurcated arms or limbs to locate a juxtaposed bag liner neck;

FIG. 6B shows completion of the bag liner neck insertion of FIG. 6A and start of a carton box outer side panel wrap around sequence to create an external envelope, concluded by top and bottom panel in-turn, overlay and tape/glue (adhesive bond) seal;

FIGS. 7A and 7B show yet another carton box outer and attendant erection and bag liner assembly sequence to that of FIGS. 6A-B;

More specifically:

FIG. 7A shows a carton box outer enclosure with ledge flap deployed to locate a juxtaposed bag liner neck;

FIG. 7B shows a successive bag liner neck capture and ledge flap fold insertion step to FIG. 7A;

FIGS. 6A-B and 7A-B depict relative orientations of carton box outer and inner bag liner for co-operative interfit—but the actual orientations of either outer or inner admit of variation.

Thus, say, given a filled bag is more securely kept upright, that is with neck uppermost—as reflected in FIGS. 6A-B—the variant of FIGS. 7A-B may be similarly disposed.

Figure 7C:
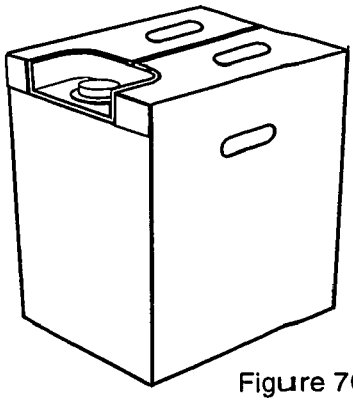
Figure 8A:
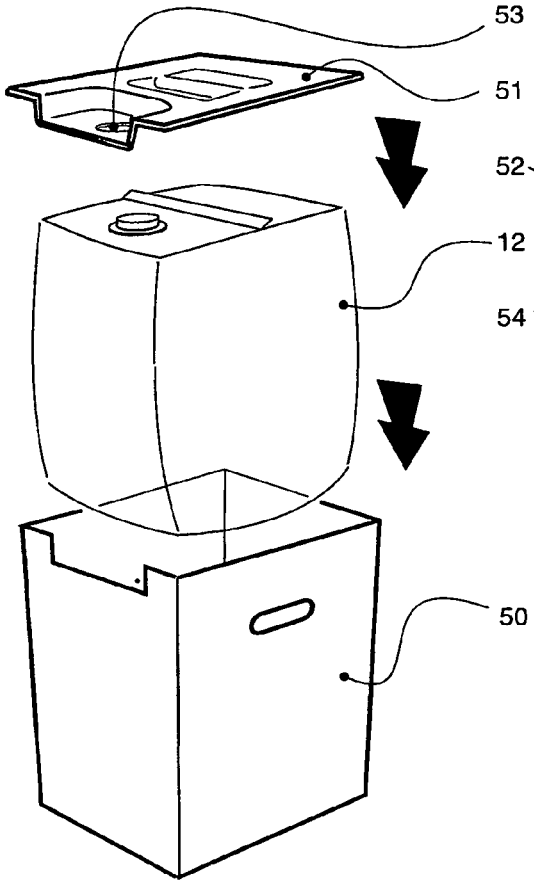
Figure 8B:
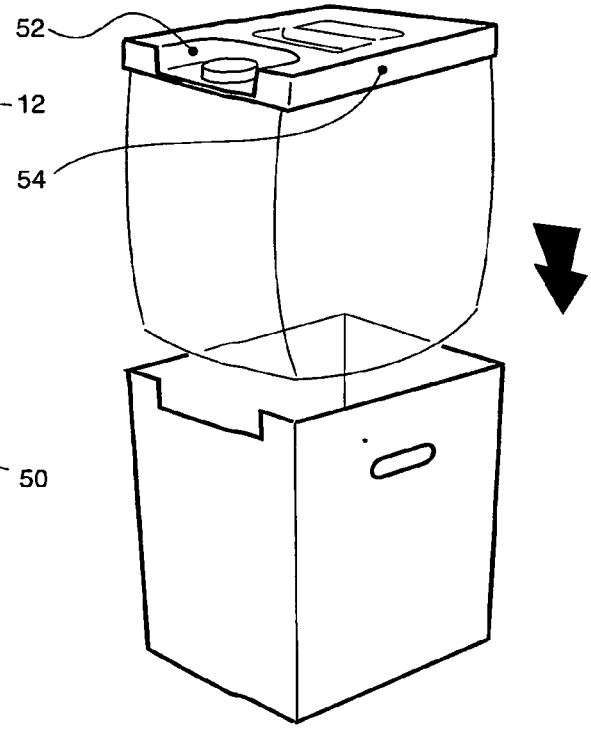
Figure 8C:
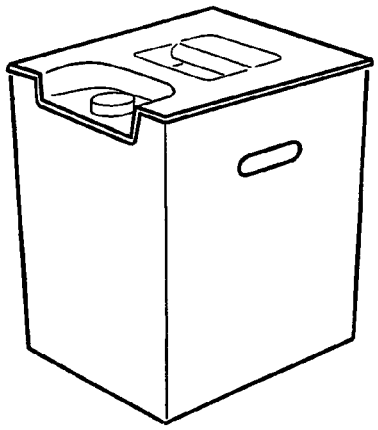
Figure 8D:
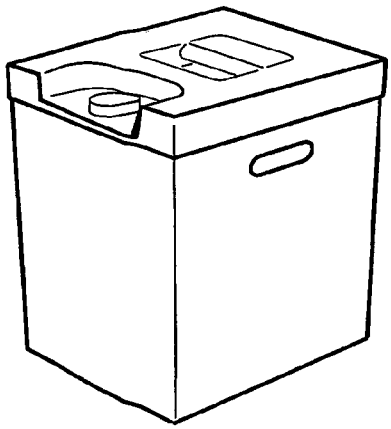
Figure 9A:
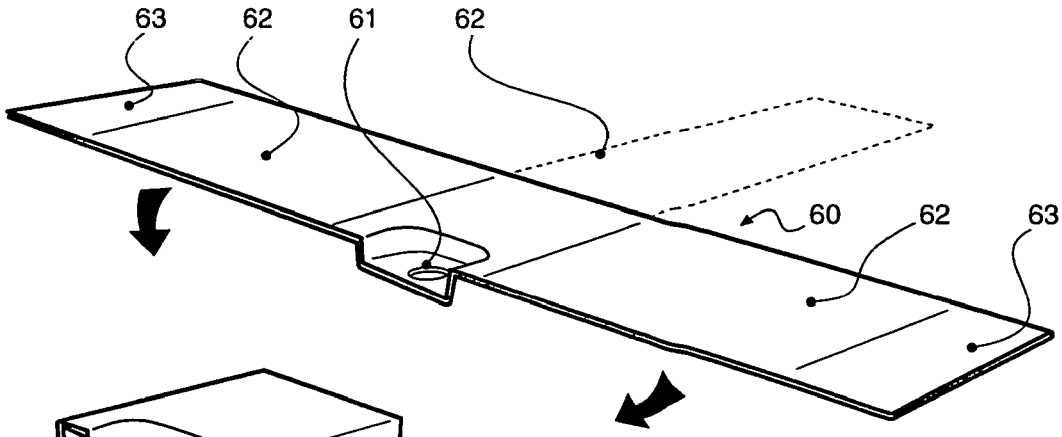
Figure 9B:
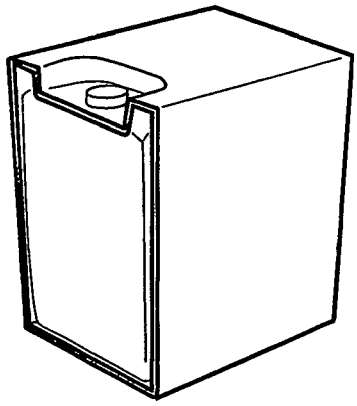
Figure 9C:
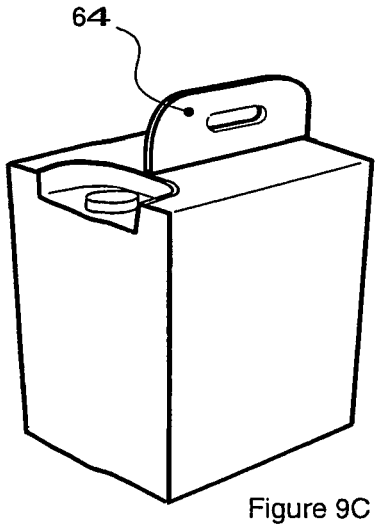
Figure 9D:
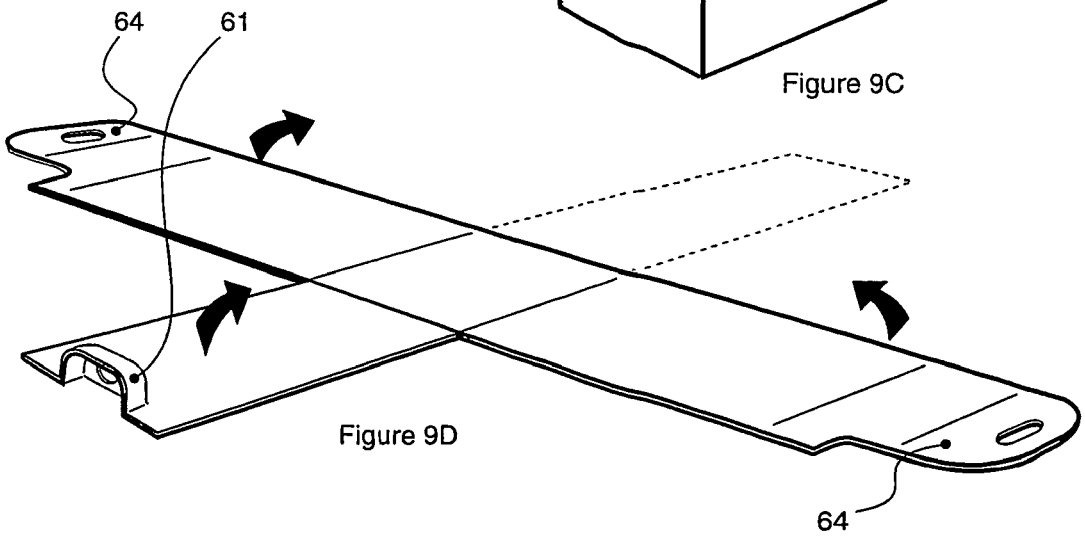
Figure 10A:
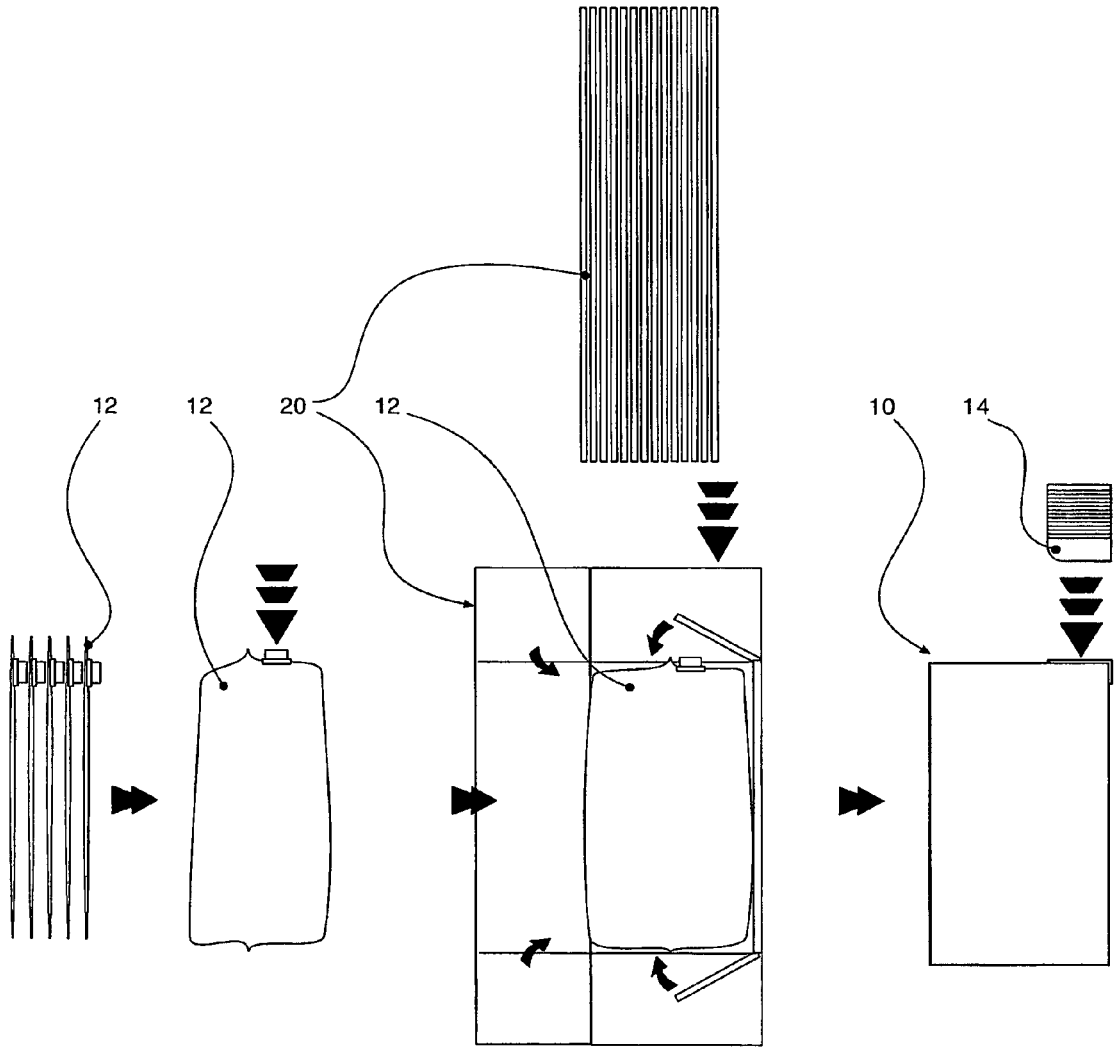
Figure 10C:
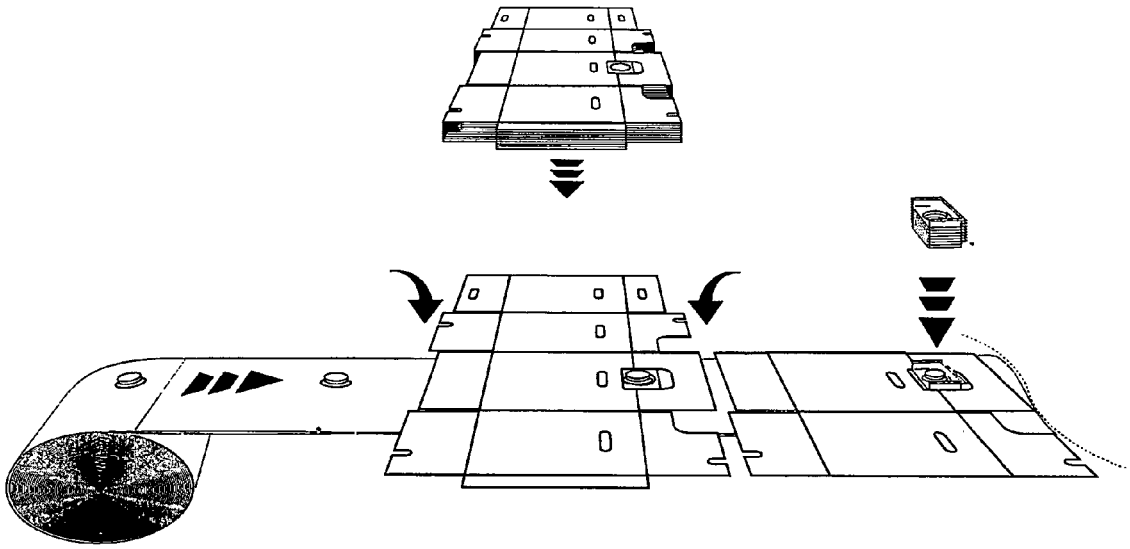
Figure 10D:
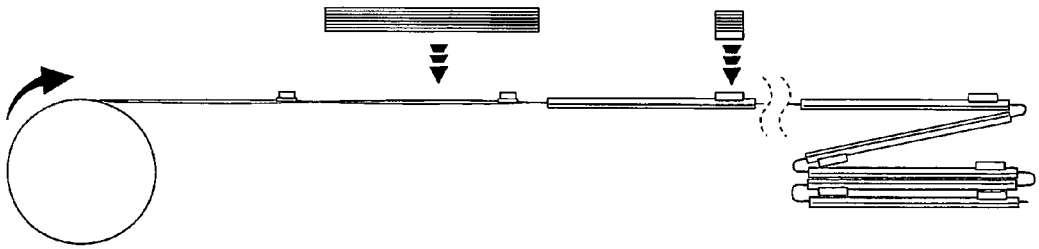

FIG. 7C shows the final carton closure stage to FIG. 7B, with top flaps fully closed—and optionally sealing tape across joins;

FIGS. 8A through 8D show variant integrations of (extended) neck piece, bag liner and carton;

More specifically:

FIG. 8A shows an exploded view of a neck piece extended as a top plate, with underlying bag liner and peripheral carton sleeve;

FIG. 8B shows a variant of FIG. 8A with integrated top tray with shallow peripheral depending rim and bag liner;

FIG. 8C shows a closed container package assembly featuring the top plate of FIG. 8A; and FIG. 8D shows a closed container package assembly featuring the top tray of FIG. 8B;

FIGS. 9A through 9D show variant neck plate formats;

More specifically:

FIG. 9A shows an extended neck plate configured as an elongate strip, sub-divided by transverse folds—with optional side offshoot panel wings;

FIG. 9B shows the neck strip of FIG. 9A wrapped around a bag inner element, as an open-sided support collar or shroud ring;

FIG. 9C shows a variant of FIGS. 9A and 9B, with a collar wrapped from below a bag inner and brought together as a handle closure, with an intervening cut-out for the bag neck; and FIG. 9D shows a laid flat 2-D carton blank form of the wrap of FIG. 9C, revealing a pre-formed neck recess;

FIGS. 10A through 10D show overall packaging assembly schemes, with bag liners web-fed to a fill-inflation-separation station for wrap around by progressive fold of a web fed carton blank;

More specifically:

FIG. 10A shows a sequence of bag liner web detachment, bag fill and merger with a collapse-folded, part-assembled, box carton wrap;

FIG. 10B shows individual box carton separation from a web or collapse-fold stack;

FIG. 10C shows a variant scheme in which a continuous bag liner web is preserved, and successive bags overlaid by respective carton blanks which are then wrapped around and edge sealed;

FIG. 10D shows a concertina stack fold of bag liner web segments with flat outer box carton wraps from FIG. 10C;

FIGS. 11A through 11D show a variant box carton construction, in which a neck aperture and recess fold is provided mid-span of a wider lid flap, without lid flap interlock—rather admitting a simple (bonded) mutual overlay.

Figure 11A:
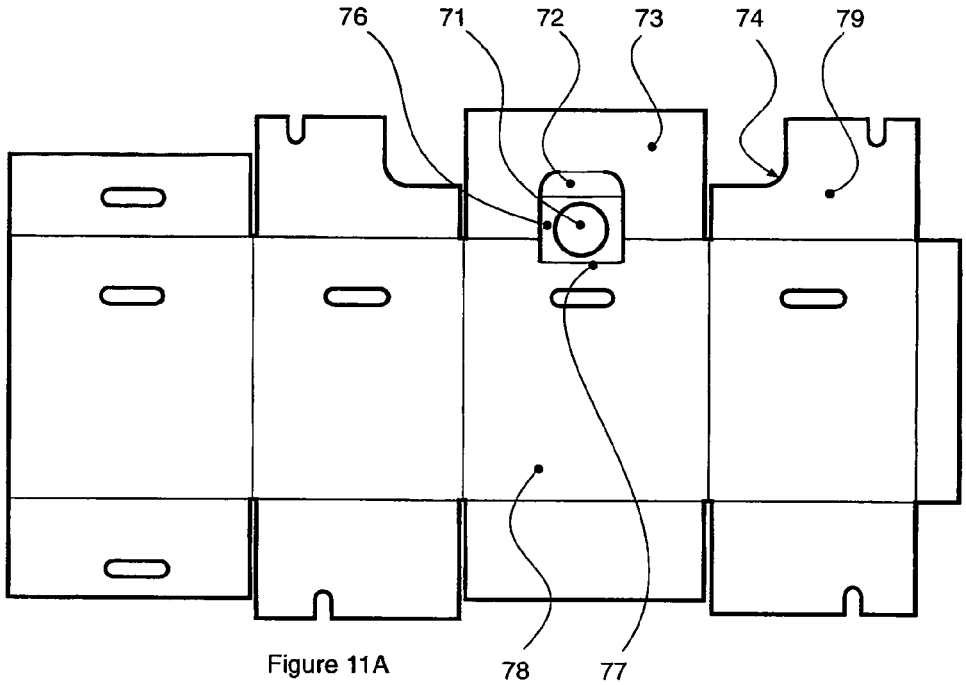
Figure 11B:
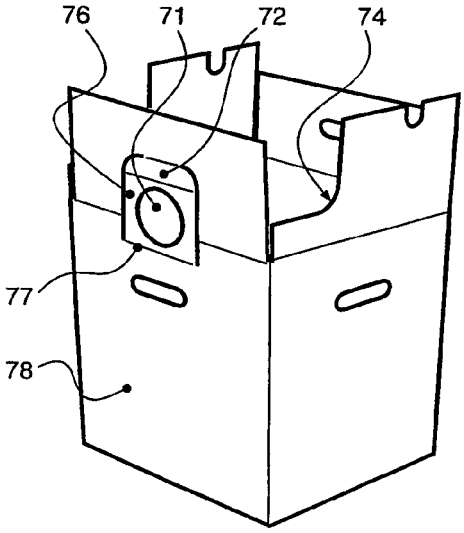
Figure 11C:
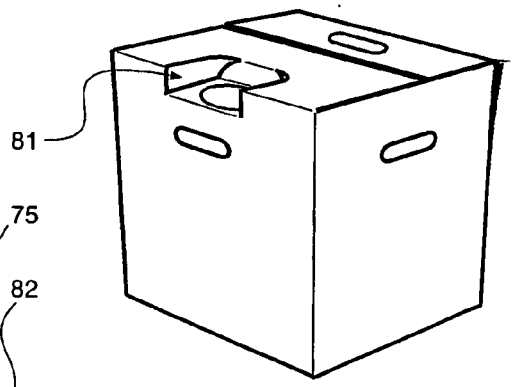
Figure 11D:
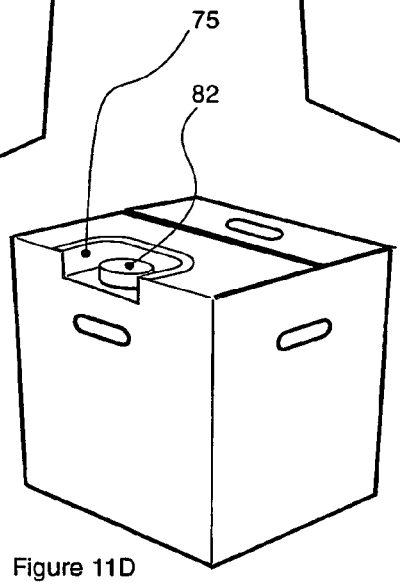
Figure 12A:
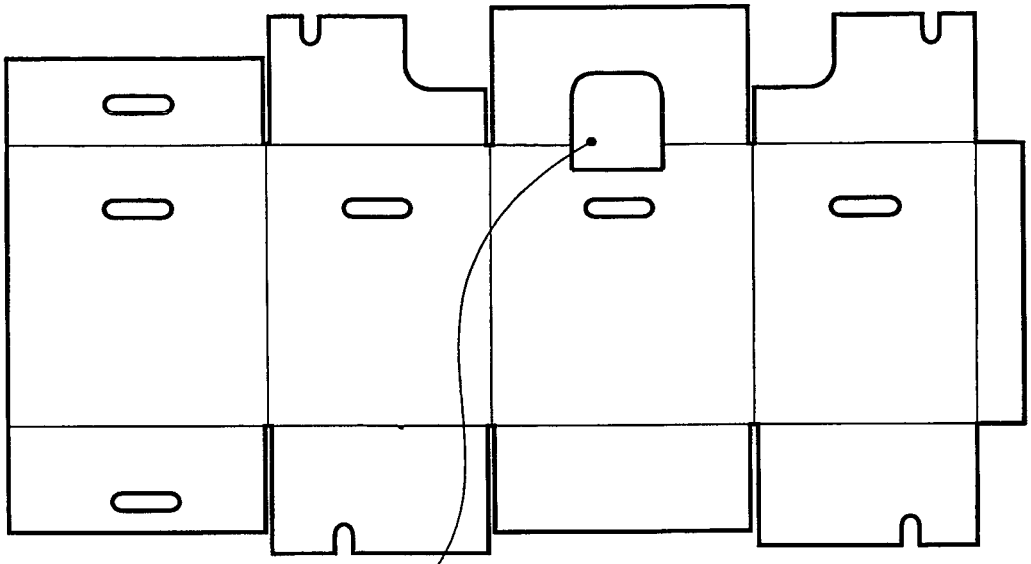
Figure 12B:
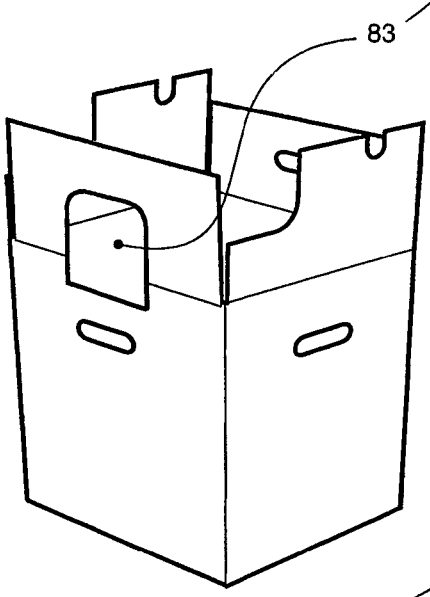
Figure 12C:
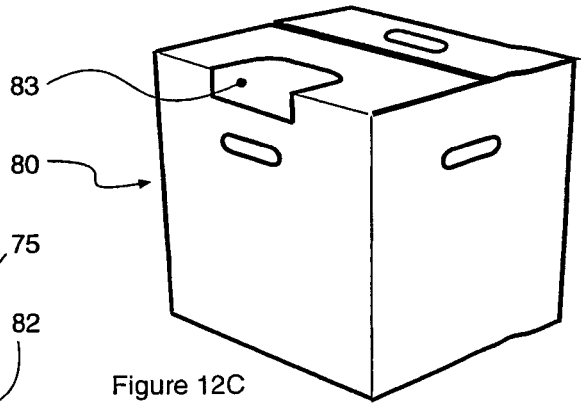
Figure 12D:
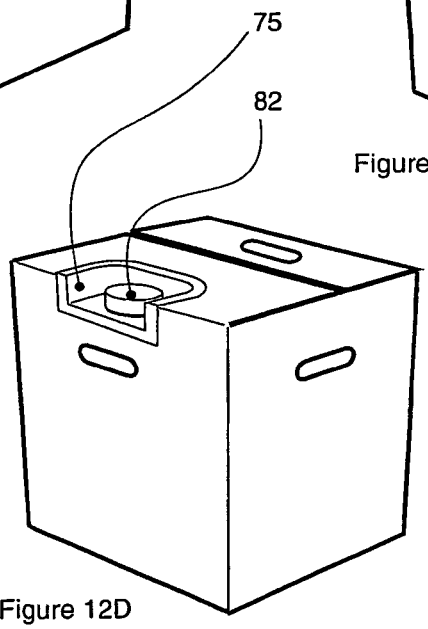
Figure 13A:
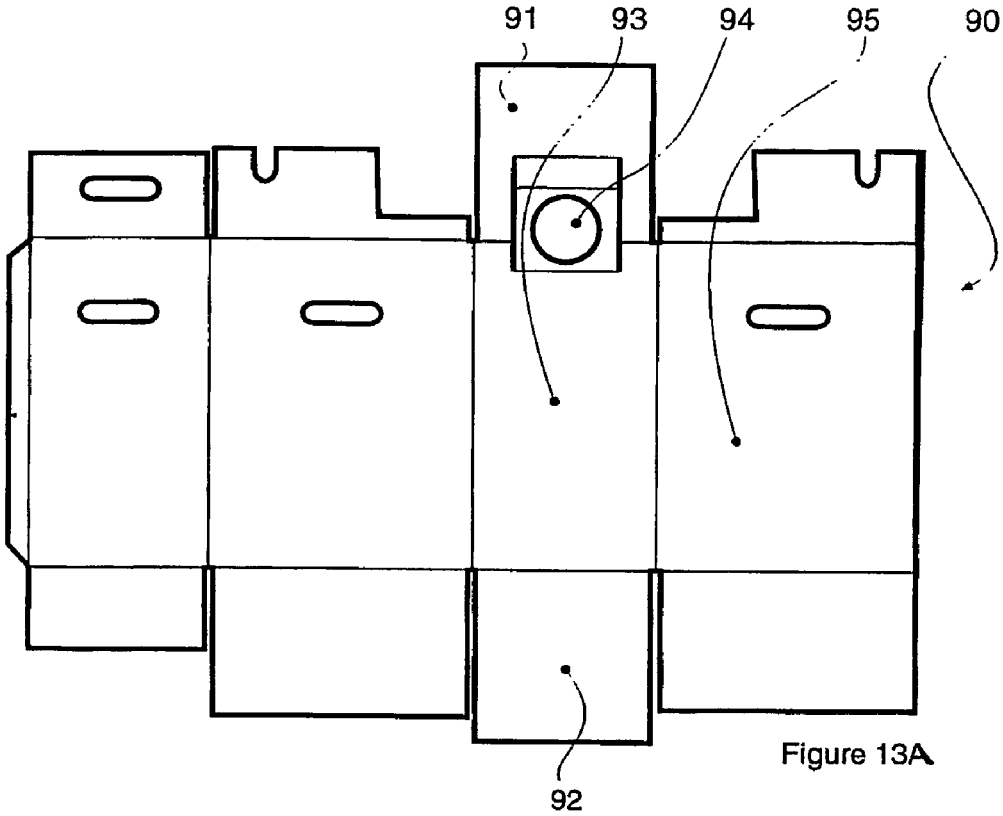
Figure 13B:
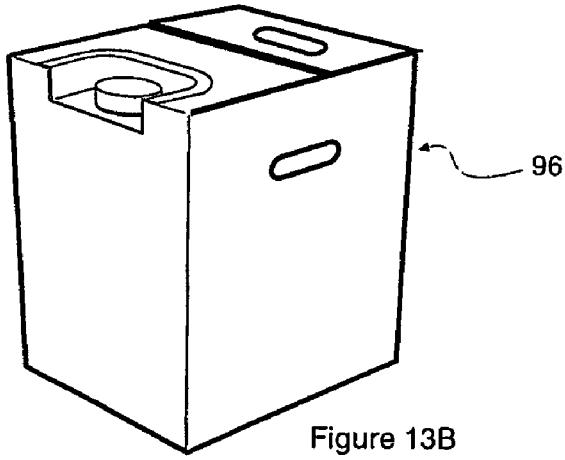

More specifically:

FIG. 11A shows a pre-fabricated 2-D carton blank, with inset bag neck location in-fold panel; it should be noted that for a square box form, end flaps are of even depth;

FIG. 11B shows a partially erected 3-D box carton enclosure, with open top lid flaps, ready to receive a bag liner (not shown);

FIG. 11C shows closure of top lid flaps and formation of a locally inset ledge or shelf recess at one (longitudinal) top edge;

FIG. 11D shows fitment of a pre-formed neck piece, configured as a shallow open-sided tray, upon the shelf recess of FIG. 11C;

FIGS. 12A through 12D show a variant of FIGS. 11A through 11D, in which the recessed shelf flap is omitted altogether, in favour of a substantial cut-out to receive a pre-formed neck piece, itself providing a shelf recess profile;

Such a cut-out is advantageous either for:

pre-filled bags, whose closure cap seal cannot be broken for neck piece fitment post box carton insertion; or sterile bags which cannot be opened prior to contents fill;

More specifically:

FIG. 12A shows a prefabricated 2-D carton blank;

FIG. 12B shows partially erected box carton with open top lid flaps, one with localised bag neck cut-out intruding into an adjoining side panel, ready to receive a bag liner (not shown);

FIG. 12C shows an assembled box carton, with top lid flaps closed, leaving exposed the localised bag neck cut-out;

FIG. 12D shows fitment of a pre-formed neck piece in the bag neck cut-out;

FIGS. 13A and 13B show a further variant of FIGS. 11A through 11D, whereby the neck aperture is provided along the narrow side of a bag in box container;

More specifically:

FIG. 13A shows a pre-fabricated 2-D carton blank, with elongated neck aperture top flap and corresponding bottom flap—to provide an off-set flap overlay upon closure;

FIG. 13B shows an assembled box carton of FIG. 13A, complete with bag, neck piece and closure cap fitment.

REFERRING TO THE DRAWINGS

A BIB container package assembly 10 comprises an inner bag liner 12 fitted within an outer box carton 11.

FIGS. 1A through 2E depict a 3-D carton erection sequence from a 2-D flat sheet carton blank 20.

To achieve a rectangular or cuboid 3-D erect form, the 2-D carton blank 20 is subdivided into a series of generally rectangular side panels 18, bounded by respective foldable end flaps 17, 19 forming the erected carton lid or base.

Various cuts, creases and score lines or folds are incorporated to pre-dispose the carton blank 20 into a fold and interlock for erect sequence.

Collapse fold of an erected carton may also be accommodated.

A significant difference over conventional cartons is a waisted neck flap 16 with aperture 24 for a bag liner neck 13.

This neck flap 16 folds to an inset ledge or recessed platform for a bag liner neck 13— and is in turn supplemented by a neck piece 14.

The neck piece 14 may be:

a discrete element—as shown in FIG. 3B;

wholly or partially integrated (or connected) with the bag liner—as shown in FIG. 4E; or wholly or partially integrated (or connected) with the box carton—as shown in FIG. 9A.

Variant neck piece 14 forms and features are depicted in FIGS. 5A through 5H.

In the assembly 10, a bag contents (fill and discharge) access neck 13 protrudes from an (upper) end flap 16 of the box carton 11 through an aperture 24.

The bag neck 13 is located by a neck piece insert or location and restraint collar 14, which engages a location rim 15 at the neck base and overlies a box carton top closure or lid flap 16.

The bag neck 13 is thus restrained from retreating into the box carton 11.

Bag neck 13 may incorporate screw thread grooves 28 for complementary interfit with a screw threaded closure cap 26.

The neck piece 14 is an open-sided shallow tray, with a 'C'—shape rim upstand and peripheral flange 25, marginally overlying a box carton upper lid flap 17.

FIGS. 4A and 4B depict a discrete neck piece 14.

FIGS. 4C through 4E depict an integrated neck piece 14 and bag liner 12.

This allows BIB use at a contents fill station for conventional jerrycans—at which neck loads are applied to trigger discharge valve operation.

Side wall and end panel handle grip apertures 21 are provided for handling upon box carton 11 assembly.

These handle apertures may feature a hinged closure flap, readily contrived cutting only part of the aperture boundary profile, and creasing a residual jointing or entrainment edge.

As is evident from FIG. 2B, one upper carton lid flap features transverse creases or folds to allow adoption of a stepped profile or ledge.

FIG. 3A shows insertion of a generic bag 12, with a top edge closure seam 30, into the open bottom end of an otherwise part pre-assembled box carton 11.

The box carton 11 has closed top flaps 17 and pre-folded inset or recessed ledge 16, ready to receive a discrete neck piece 14, as shown in FIG. 3B.

Neck 14 piece fitment, such as shown in FIGS. 4A and 4B, effectively retains the bag liner 12 within the box carton 11, while bottom flaps 19 are folded closed, overlaid by tape 27 and/or adhesive bonded.

FIGS. 7A through 7C show an alternative top end box carton loading sequence to the bottom end loading of FIGS. 3A through 3C.

Again, the box carton 11 is part pre-assembled into a wrap, but with closed bottom end flaps 19 and open top flaps 17, 41 for access.

As the bag liner 12 remains accessible throughout box carton insertion, such top-loading might be adopted for either an empty or filled bag liner 12.

An extended top flap 41, with split or bifurcated limbs 42 about neck location aperture 43, guide bag neck access, and folds down, bringing the bag along with it, culminating in closure and formation of a recess for the otherwise protruding bag neck 13, as depicted in FIG. 7C.

FIGS. 6A and 6B show bag liner 12 and box carton 11 assembly with the carton reverse folded preparatory to formation of a wrap enclosure.

A top lid flap 41, with bifurcated opposed guidance limbs 42 to a neck location 43, is turned back to facilitate juxtaposition with a (filled) bag liner 12, as depicted in FIG. 6A, preparatory to wrap around fold of carton side walls 18, as depicted in FIG. 6B.

FIGS. 8A through 8D show 'drop-in' top-loading for a bag liner insert in an open-top pre-assembled box carton 'bucket' 50.

A top plate or tray 51, with integral step ledge or recess 52 around a neck location aperture 53, substitutes for carton top lid flaps 16, 17.

Such a tray is either:

a discrete element 51—as reflected in FIGS. 8A and 8C; or integrated, through a peripheral depending flange or rim 54, with a bag liner 12—as reflected in FIGS. 8B and 8D.

Carton and neck piece integration is implemented in another way in FIGS. 9A-D, by a contiguous top plate or strip 60, with local recessed neck aperture 61, side walls 62 and end closure flaps 63.

The strip is brought over a filled bag liner 12, as depicted in FIG. 9A and wrapped around as a ring, loop or band, as depicted in FIG. 9B.

FIGS. 9C and 9D show a wrap executed from below a filled bag liner 12, with optional cruciform carton blank contour, as depicted in FIG. 9D, to provide side walls 62 for a complete enclosure brought together with top handle elements 64, as depicted in FIG. 9C.

Carton lift by such handles 64 thus helps secure the wrap around the liner and vulnerable bottom flap joins are avoided in favour of a continuous panel (loop or ring) sequence.

The choice of individual and co-operative box carton 11 and bag liner 12 configurations reflects the intended assembly and fill sequence.

FIGS. 10A and 10B reflect an abstraction of automated assembly from respective web fed collapsed bag liner 12 and box carton 11 stacked flat pack lines.

FIGS. 10C and 10D reflect a variant automated assembly preserving a continuous bag liner web, with individual bags wrapped in respective flat box carton wraps.

The bag liners and/or box cartons can feature neck piece fitment, connection or integration—preparatory to uniting of bag liner and respective box carton wrap while still entrained in a continuous web.

In a concertina fold stack of FIG. 10D necks and neck-pieces alternate for compactness.

Box carton 11 flat pack facility is contingent to some extent upon recessed neck piece 14 profile—hence the advantage of the shallow tray 31 forms of FIGS. 5A through 5H.

In that regard, introducing a drip guard or splash back extension 35, as indicated in broken line in FIG. 5A, may still be accommodated, by allowing a crease or fold and a corner edge junction.

Again, bag liner 12 pre-fill or post-fill can be accommodated.

Alternative neck piece configurations may include an integral funnel 38, a flip-top lid 32, a pourer or spout 33, a pop-out handle 34, a frangible tear strip 36, or a lock 37.

Compact transport and storage can be preserved for either bag liner 12 or box carton 11 elements, individually or together, until pre-erection of a hollow shell format preparatory to contents fill.

Conceivably, contents fill itself could be used to promote such pre-erection of interfitted bag liner 12 and collapse folded box carton 11—albeit not shown.

FIGS. 11A through 11D reflect a refinement of the box carton 11 format of FIGS. 1A through 2E.

That said, corresponding bag liner 12 insertion and neck-piece 14 fitment considerations, such as of FIGS. 3A through 5H generally apply.

Similarly, with the minimal neck cut-out box carton variant 80 of FIGS. 12A through 12D.

Neck location lid (end) flap or panel 16 of FIG. 1A occupies the full panel width and, upon in-fold and carton erection, interlocks with juxtaposed side lid flaps or panels 17 through slots 29.

In an alternative format, a bag neck location panel 76 occupies only a localised (mid-) portion of a carton lid flap or panel 73, as depicted in FIG. 11B.

Moreover, lid panel 73 interlock can be substituted by simple lid panel 73 mutual overlay and adhesive bonding and/or supplementary edge joint taping 27.

Thus, an inset (bag neck location) panel 76 has an aperture 71 to receive a bag neck 13 (not shown).

Neck panel 76 spans between a base edge fold 77, marginally inset from the top edge of a side panel 78 and a step fold panel 72 intruding into lid panel 73.

A corner cut-out profile 74 of adjacent lid panels 79 accommodates the neck panel 76 when the lids are folded over to close the carton top, as depicted in FIG. 11C.

Rounded corners may be adopted to relieve stress and complement a corresponding neck piece profile, or a rectangular corner may be overlaid by a rounded neck piece corner profile.

In that carton closed condition, the neck panel 76 is inset as a recessed ledge 81.

A discrete pre-profiled neck piece insert 75, configured as a shallow open-sided tray, is sited upon ledge 81, as shown in FIG. 11D, and retains a protruding bag liner neck 13 with closure cap 82.

The carton variant of FIGS. 12A through 12D further refines the proposition, with a complete neck cut-out 83, of corresponding outline to but substituting for, neck panel 76 of FIG. 11A.

Upon carton closure, as depicted in FIG. 12C-*again* with a bag liner 12 insert omitted for clarity of illustration, a neck aperture 83 is created generally mid-span along one top corner edge of the carton.

Into this neck aperture 83 is fitted a pre-formed neck piece 75, for bag liner 12 insert retention at a protruding bag neck 13, as depicted in FIG. 12D.

A further carton variant is shown in FIGS. 13A-B, whereby a similar neck aperture 94 to that depicted in FIG. 11A is adopted, however, this time it is provided along the narrow side 93 of a cuboid container.

Alternatively, neck aperture 94 could be provided on along the wider carton side 95.

The carton blank 90 in FIG. 13A is provided with an elongated neck aperture top flap 91 and corresponding bottom flap 92—thus affording greater space for neck collar fitment and contents access.

Consequently, an off-set flap overlay results upon carton closure.

FIG. 13B shows an assembled box carton 96 constructed from the carton blank 90 of FIG. 13A.

This is complete with internal bag, neck piece and closure cap fitment.

In FIGS. 11A-D, 12A-D and 13A-B variants a recessed neck and attendant closure are contrived—preserving a uniform, in this case rectangular, outer container profile or contour.

Generally, for simplicity of fabrication, rectangular carton forms are convenient, in principle other, say curvilinear forms could be contrived with appropriate delineation of cuts, creases or folds in a 2-D carton blank.

Either single or multiple, co-operatively interacting carton blank forms may be employed—say for increased overall sizing, beyond individual carton sheet supply constraints and/or more complex forms.

Inter-nesting carton and/or bag forms may be employed for greater robustness and security.

Thus, say, a multiple-walled structure would afford redundancy against impact or penetration—useful in spillage containment for hazardous contents.

Mix'n Match Features

The various embodiment features may be 'mixed and matched' selectively—albeit it is not feasible to show every possible feature permutation or combination.

JERRIBOX™ vs Jerrycan

The following outline is presented by way of supplementary perspective upon the particular embodiments described separately, in relation to traditional jerrycans:

Overall Objective

A so-called JERRIBOX™ {which term is used for convenience herein} according to the present invention is a bag-in-box container package emulating certain traditional plastic [jerrycan] container characteristics, whilst delivering significant supply chain benefits.

It represents an integrated packaging approach to containerisation.

Positive jerrycan characteristics summarise as:

User familiarity;
Ease of use;
Accessible cap/pouring;
Ease of filling;
Outdoor or damp atmosphere compatibility;
Robustness;
Option of attaining so-called 'UN' certification for hazardous goods;
Product size range;
Availability and price.

A JERRIBOX™ provides these characteristics, but in a BIB package—with a pack look of a jerrycan container and equivalent functionality.

Thus, for example, the cap is exposed and the pouring handle is behind the cap.

Moreover, in terms of competitive containers, smaller sized jerrycans are commonly assembled into a combination pack within an outer box—to facilitate palletisation and allow surface graphics.

The JERRIBOX™ obviates the need for outer carton wraps and allows shrink-wrapping of stacked units.

JERRIBOX™ Features

Moreover, the JERRIBOX™ provides major benefits compared with a conventional jerrycan container:

1. In-bound Material Logistics

JERRIBOX™ can be supplied flat-packed, in pallets or containers.

Jerrycans are supplied as complete bottles and inevitably involve shipping fresh air.

This means frequent packaging replenishment delivery and unproductive use of valuable packaging storage space.

A recent customer study showed a former need for 250 pallets a week of jerrycans reduced to 25 pallets a month of flat-pack BIB material.

2. Individual Usage

The flat pack facility of JERRIBOX™ is also beneficial beyond business-to-business applications.

Thus, camping caravanning and other outdoor pursuits can gain from travelling space usually occupied by large, fixed-form, water carriers.

Water carriers supplied flat-packed could also be of major advantage in disaster relief.

Flat-pack fuel containers are also feasible, with appropriate materials.

Containers could feature integrated ground wheels or skids and bespoke trolley carriages contrived.

3. Out-Bound Logistics

JERRIBOX™ containers filled with product are more efficiently packed, stacked, palletised and containerised than jerrycans.

The latter are usually packed overlapping the pallet (periphery) to help achieve a more stable load.

Jerrycans also lose capacity to handles and radiused surfaces.

A JERRIBOX™ could be sized to fit standard pallets precisely, for an intrinsically stable load.

That is close mutual juxtaposition and abutment of load elements inhibits their relative movement.

A JERRIBOX™ pack is lighter than an equivalent size jerrycan—contributing to pack load efficiency.

4. Waste Disposal

At the far end of the supply chain many jerrycan products are difficult to dispose of into the waste stream.

This can result in elaborate and costly 'reverse logistics'.

JERRIBOX™ again takes advantage of flat-pack benefits as the plastic and paper elements divide easily into respective waste streams.

The lower packaging weight gives cost advantages in packaging waste obligations.

5. Product Presentation

A JERRIBOX™ container outer surface can display product branding, promotion and information—in simple formats through to multi colour high quality laminated finishes.

In contrast, Jerrycans are usually limited to labelling or sleeves—with limited decorative surface.

JERRIBOX™ Design

To ensure that JERRIBOX™ competes effectively with the jerrycan at the most important point . . . in the hands of the end user . . . several design elements have been created.

1.

Bags used in the JERRIBOX™ range may be generic free-form pillow bags or of complementary rectangular format, such as from the proprietary QUAD range, manufactured by C-PAC International.

They have two features complementary to the JERRIBOX™ and significant to achieving jerrycan container feature emulation, vis:

bags are top-filling and dispensing; and adopt a space efficient ['cuboid'] filled shape.

Such bags are available in a wide range of sizes and materials, and in single or double layer formats.

Liquids from most industries can be accommodated.

2.

JERRIBOX™ features an integral recessed or inset supporting 'shelf', or bracing ledge, for a container neck and cap.

The recess allows inset of an otherwise protruding neck and closure cap within a rectangular outer box carton profile—allowing space-efficient compact stacking and packing, such as upon palletisation.

The shelf profile interlocks with other carton (top) flaps, for maximum strength.

This shelf uses minimum material and is within an otherwise conventional '0201' box configuration.

An exposed accessible cap and filler is an important functional link with a jerrycan and allows former users of jerrycans to fill with existing equipment.

Over a JERRIBOX™ range, box sizes have been optimised for palletisation on regular and eur-pallets.

3.

This supporting shelf—and its function of holding a liquid (bag) container neck of—is enhanced by a pre-formed plastics collar insert, or neck piece, configured to:

snap fit around a bag liner neck flange;

assist bag support; and supplement carton wall (board)stiffness, upon liquid damage.

The collar is shaped to:

close off an otherwise open area of the box carton around the neck; and protect exposed edges of box material, again from dampness.

The collar also locally reinforces the box, while partially surrounding and protecting the cap.

Pack integrity is maintained in pallet stacking, or if the pack is dropped onto its top face.

Collar profile may be minimised—for consistency with carton flat-pack, or optionally extended—as a splash guard to prevent local carton soaking at the neck.

Collar design also enhances JERRIBOX™ identity and appearance—making it immediately identifiable as a jerrycan competitor or substitute.

4.

The collar provides a basis for optional features, vis:

configuration to a minimal sized, simpler format yoke—to save cost, particularly on smaller size packs; board protection and support would be preserved, albeit without necessarily an appearance benefit.

(flip-top) lid, to protect an exposed cap;

integrated lid pourer or spout; and handle folding into collar recess.

Tamper evident seals and even cap locks are feasible.

Collar and attachment sizing allows adaptation for different sized necks.

5.

The box carton admits die-cut flat material.

Overall, JERRIBOX™ equals or betters entrenched plastic jerrycan functionality.

Environmental water, damp or splash proofing can be accommodated.

Filling and dispensing can also create dampness—although the collar protects the carton from spillage.

Occasional leakage can be contained by proofed carton board.

This avoids individual wetted box collapse and entire pallet spoilage risks.

Carton board options embrace:

fully waterproofed solid;

one-side protected solid;

coated corrugated;

regular non-water-protected corrugated;

plastics corrugated;

solid or laminated (plastics) sheet (to allow profile preform);

Most such boards are available in a wide range of printed formats.

It is anticipated that fully waterproofed solid board will be a lead constituent.

6.

A size range can imitate/emulate the jerrycan, vis:

3 litre 5 litre 10 litre 15 litre 20 litre 25 litre

4×3 litre

3×5 litre multi-pack

2×10 litre multi-pack

Unlike prohibitive mould tooling costs for jerrycans, it would feasible, at relatively modest cost, to contrive bespoke JERRIBOX™ sizes and configurations for particular customer and market needs—such as imperial, metric or US volumetric measures.

7.

Package assembly is an important consideration, given that existing industrial jerrycan users do not need to assemble the pack—although labelling is an extra activity.

The drawings variously depict assembly and tape or glue closure, undertaken by mixed manual and mechanised operations, together with automated pre-assembly of bag liner and box carton.

8.

For some important market sectors, the JERRIBOX™ will need to pass UN certification testing—although there is a large market where this is not essential.

Certification will likely be with fully water-proofed solid board cartoning.

COMPONENT LIST

10 package
11 carton box outer
12 bag liner
13 bag neck/spout
14 neck collar
15 neck rim
16 ledge flap
17 top flap
18 side wall panel
19 bottom flap
20 carton blank
21 handle aperture
24 neck location aperture
25 rim flange
26 closure cap
27 bonding tape overlay
28 screw groove
29 slot
30 top edge closure seam
31 yoke
32 flip-top lid
33 pourer
34 pop-out handle
35 splash back extension
36 frangible tear strip
37 lock
38 integral funnel
41 bifurcated ledge flap
42 limb
43 access (entry) slot
50 box carton 'bucket'
51 top plate
52 step ledge
53 neck location aperture
54 top plate rim
60 contiguous carton strip
61 recessed neck aperture
62 side walls
63 end flaps
64 top handles
71 neck aperture
72 recess fold
73 wide lid flap
74 cut-out profile
75 pre-formed neck piece
76 neck location panel
77 base edge fold
78 side panel
79 lid panel
80 minimal neck cut-out box carton
81 recessed ledge
82 closure cap
83 neck cut-out
90 carton blank
91 top flap
92 bottom flap
93 narrow side
94 neck aperture
95 wide side
96 carton

The invention claimed is:

1. A bag in box packaging comprising;

an outer carton having a first wall and a plurality of side walls depending from the first wall, a carton opening extending through the first wall and one side wall of the plurality of side walls, the outer carton defining a carton cavity;

a bag positioned within the carton cavity of the outer carton, the bag having a neck with an opening providing ingress into the bag; and a collar having a tray, a rim upstand extending upwardly from the tray and a peripheral flange extending outwardly about the rim upstand at an upper end of the rim upstand opposite the tray, the tray further including a collar opening extending therethrough, wherein the collar is attachable to the outer carton through insertion of the tray and the rim upstand into the carton opening, upon full articulation thereof, to, in turn, be positioned within the carton cavity, wherein the peripheral flange cooperates with the outside of the outer box carton about the carton opening at the first wall and the one side wall of the plurality of side walls to engage the outer carton and to preclude passage of the entirety of the collar into the carton cavity through the carton opening, and wherein the neck of the bag is coupled to the collar opening so as to be surrounded by the tray of the collar, and so as to extend into a collar cavity defined by the tray and the rim upstand of the collar.

2. The bag in box packaging of claim 1 further wherein the first wall comprises a top wall and the adjacent wall comprises a front wall, and the outer carton comprises a six sided box carton.

3. The bag in box packaging of claim 1 wherein the rim upstand comprises a substantially "c" shaped component that extends about the perimeter of the tray of the collar corresponding to the portion of the carton opening defined by the first wall.

4. The bag in box packaging of claim 1 wherein the portion of the neck that extends through the opening is fully contained within the collar cavity.

5. The bag in box packaging of claim 1 wherein the collar further includes a front flange extending from the rim upstand and cooperating with the outside of the outer box carton about the carton opening to engage the outer carton and to preclude passage of the entirety of the collar into the outer carton through the carton opening.

6. The bag in box packaging of claim 5 further including a depending front lip extending from the tray and cooperating with the outside of the outer box carton about the carton opening to engage the outer carton and to preclude passage of the entirety of the collar into the outer carton through the carton opening.

7. The bag in box packaging of claim 6 wherein the front flange, the depending front lip and the peripheral flange are substantially continuous and form a continuous structure that interfaces with the outside of the box along the perimeter of the outer carton opening.

8. The bag in box packaging of claim 1 further comprising a bag neck location panel formed from a portion of the first wall and the adjacent wall corresponding to the carton opening the bag neck location panel defining the location of the collar so that upon insertion the collar abuts the bag neck location panel.

9. The bag in box packaging of claim 1 wherein the collar further includes an integrally formed funnel extending from the tray.

10. The bag in box packaging of claim 1 wherein the collar further includes a lid extending about the rim upstand to, in turn, cover the cavity defined by the tray and the rim upstand, and to preclude ingress to the neck of the bag positioned within the cavity.

11. The bag in box packaging of claim 10 wherein the lid further includes a frangible tamper evident structure which evidences removal or displacement of the lid relative to the tray.

12. The bag in box packaging of claim 1 wherein the collar further includes a handle member coupled thereto, the handle member structurally configured to facilitate lifting of the bag in box packaging.

13. The bag in box packaging of claim 1 wherein the collar comprises pre-formed plastics member.

14. The bag in box packaging of claim 1 wherein the outer carton is presented in a collapsed configuration with the bag within the outer carton and the collar positioned on the outside of the outer carton so that upon articulation of the outer carton, the collar is inserted into the carton opening and the bag is within the carton cavity.

* * * * *